United States Patent [19]

Kuhn

[11] Patent Number: 4,828,531

[45] Date of Patent: May 9, 1989

[54] SYNTHETIC EYE SIMULATING EYEBALL MOVEMENT

[76] Inventor: James O. Kuhn, 140 Nassau St., New York, N.Y. 10038

[21] Appl. No.: 185,850

[22] Filed: Apr. 25, 1988

[51] Int. Cl.[4] ..... A63H 3/38; A63H 3/40

[52] U.S. Cl. ..... 446/392; 446/341; 446/389

[58] Field of Search ..... 446/392, 391, 393, 389, 446/385, 337, 338, 339, 340, 341, 372, 369, 268

[56] References Cited

U.S. PATENT DOCUMENTS

| | | | |
|---|---|---|---|
| 1,337,354 | 4/1920 | Garrigue | 446/389 X |
| 2,466,278 | 4/1949 | Rupert | 446/392 |
| 2,670,569 | 3/1954 | Heina | 446/392 |
| 3,841,019 | 10/1974 | Lorenzo | 446/392 X |
| 3,952,445 | 4/1976 | Liebert | 446/389 X |
| 4,233,776 | 11/1980 | Suzuki | 446/392 |
| 4,409,754 | 10/1983 | Moreau | 446/392 |

FOREIGN PATENT DOCUMENTS

| | | | |
|---|---|---|---|
| 1120334 | 12/1961 | Fed. Rep. of Germany | 446/389 |
| 631957 | 1/1962 | Italy | 446/392 |

*Primary Examiner*—Robert A. Hafer

*Assistant Examiner*—D. Neal Muir

*Attorney, Agent, or Firm*—Michael Ebert

[57] ABSTRACT

A toy figure having artificial eyes which when viewed by an observer, create, as a result of an optical illusion, apparent eyeball movement as the observer changes his orientation relative to the figure. Each artificial eye is constituted by a case formed of a transparent sphere or truncated sphere having a ball supported concentrically therein to simulate an eyeball. The artificial eye is mounted on the head of the figure to expose its convex frontal section, this being covered by a mask having a window therein which displays the eyeball and the regions above and below the eyeball and those on either side thereof. As a consequence, an observer looking at the artificial eye in a direction normal thereto in alignment with the eyeball center sees the eyeball in its centered position. But as the observer changes his position relative to the figure and views the eye through the window in a direction at an angle to the alignment direction, then the eyeball appears to be displaced from its centered position upwardly or downwardly or to one side thereof to an extent that depends on the angle of view, whereby the eyeball seems to follow the observer's movement.

10 Claims, 2 Drawing Sheets

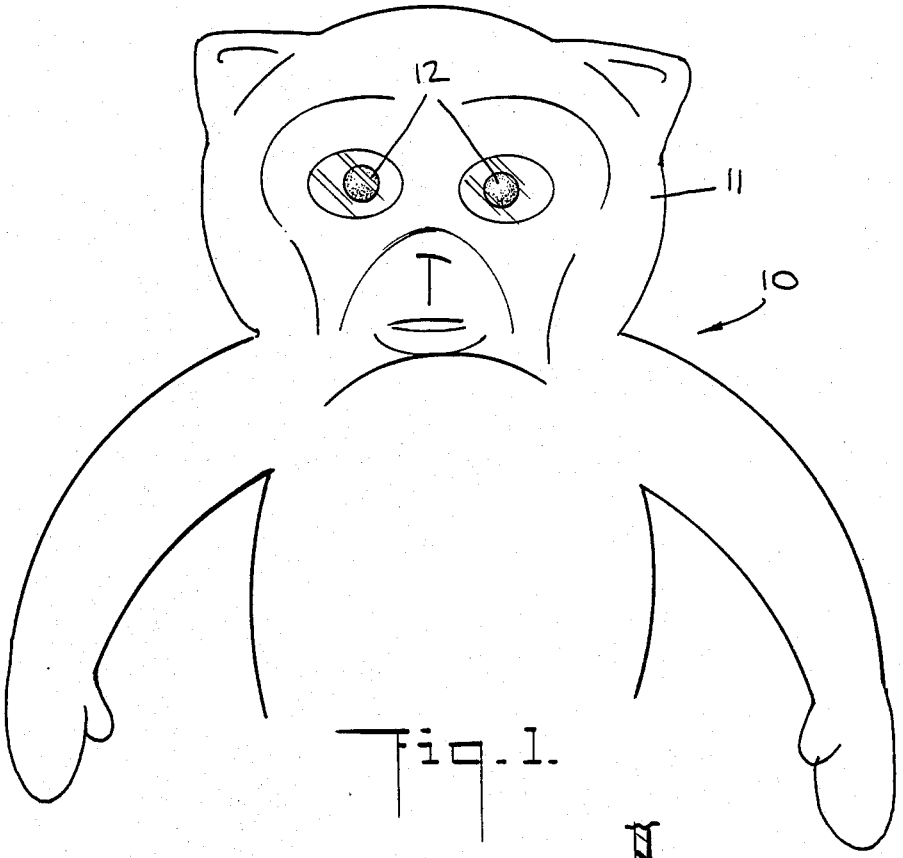
Fig. 1.
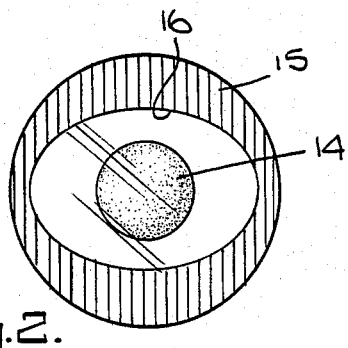
Fig. 2.
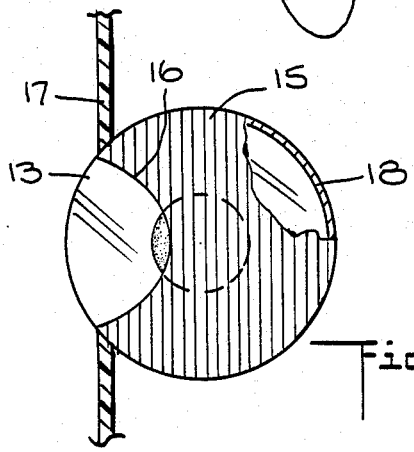
Fig. 3.
Fig. 4.
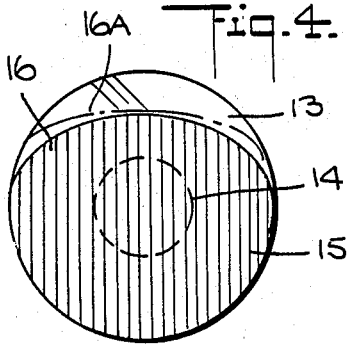
Fig. 5.
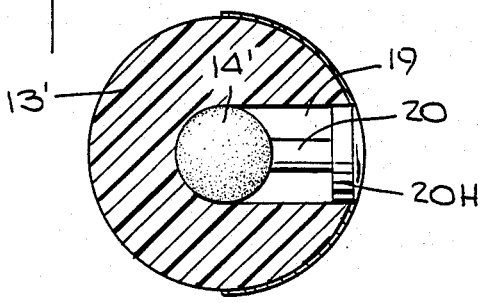

Fig. 6.
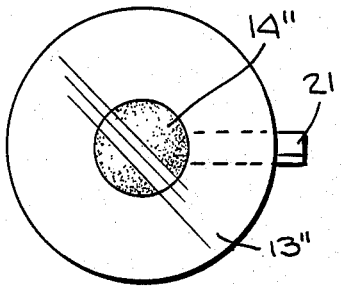
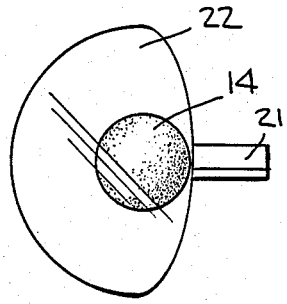
Fig. 8.
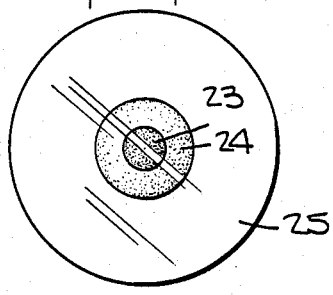
Fig. 7.
Fig. 9A.
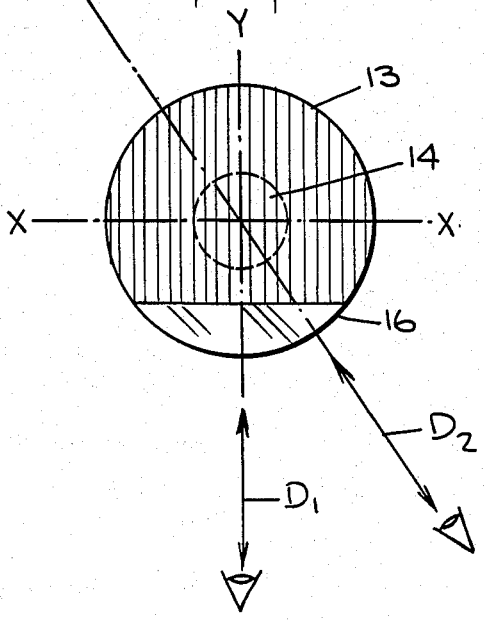
Fig. 9B.
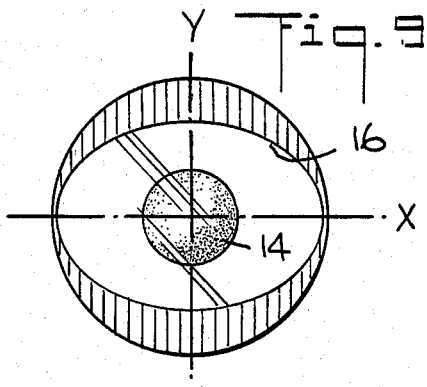
Fig. 9C.
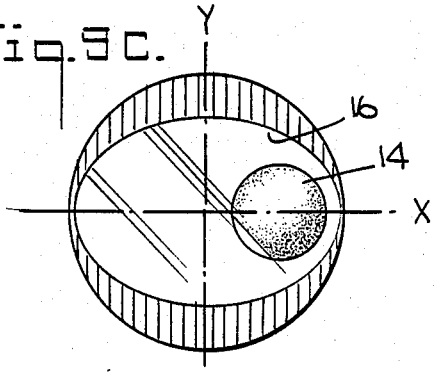
Fig. 9D.
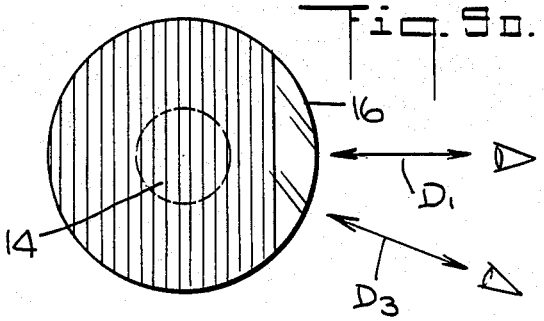
Fig. 9E.
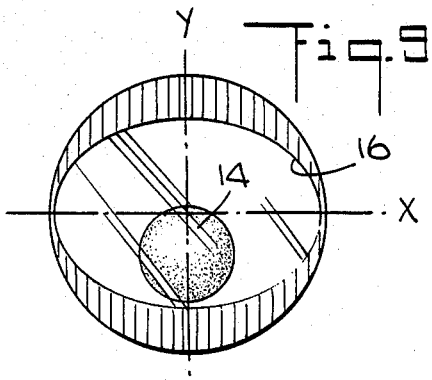

SYNTHETIC EYE SIMULATING EYEBALL MOVEMENT

BACKGROUND OF INVENTION

1. Field of Invention

This invention relates generally to toy figures or characters having artificial eyes, and in particular to figures or characters of this type in which the eyes simulate, by means of an optical illusion, eyeball movement with respect to an observer whose angular position changes relative to the eyes, whereby the eyes appear to follow the observer.

2. Status of Prior Art

Since the invention deals with artificial eyes that appear to follow the observer as his orientation changes relative to the eyes and therefor simulate animation, the nature of a natural eye must first be considered.

The eye, which is the organ of vision, is a spheroid structure that rests in a bony cavity or socket on the frontal surface of the skull. It is filled with a jellylike, vitreous humor contained within three covering layers: the sclera, the choroid and the retina. The sclera is the outermost layer of eye tissue, a portion of which is visible as the white of the eye. In the center of the visible sclera and projecting slightly therefrom is a transparent cornea that acts as the window of the eye. Underneath the sclera is a second tissue layer, the choroid composed of blood vessels.

As the sclera nears the center of the visible portion of the eye, it merges with a ciliary body containing muscles used in focusing, which body in turn merges with the iris, the pigmented portion of the eye whose center is perforated and appears as the pupil. Back of the iris is a transparent lens. The third and innermost layer of tissue, the retina, contains nerve fibers.

The eyeball is a more or less globular capsule formed by the sclera and cornea together with their contained structure. In a synthetic eye of the conventional type used in play dolls, toy figures and characters, the eye is usually constituted by a transparent plastic dome, within which is a clolored eyeball, the annular region in the dome surrounding the eyeball being in a contrasting color.

The natural eye is sometimes referred to poetically as the window to the soul, for the eye more than any other organ of the body is highly expressive. It is for this reason that most people are disturbed by a blind person whose eyes are not concealed by dark glasses, for these eyes appear to be dead. This has the unfortunate effect of making it seem that the blind person is zombie-like and not truly alive.

The typical artificial eye in a doll or toy figure is also devoid of life, the eye being dull and spiritless. To avoid this negative effect, attempts have been made in toy figures to impart animation to the eyes. Thus, in the Spector U.S. Pat. No. 4,521,205, the eyes in a toy figure take the form of eye openings covered by a transparent lens behind which is the end of a fiberoptic light pipe. Intermittent light is conducted through this pipe so that the eyes are intermittently illuminated and thereby animated.

The approach taken in the Spector patent requires a modulated light source and other components which are relatively expensive. Moreover, an eye which is intermittently illuminated does not give the impression of a natural eye in which the eyeball is capable of movement, for there is no eyeball in the Spector eye, to say nothing of eyeball movement.

SUMMARY OF INVENTION

In view of the foregoing, the main object of this invention is to provide artificial eyes for toy figures and characters which when viewed by an observer creates, as a result of opitcal illusion, apparent eyeball movement as the observer changes his angular orientation relative to the eyes of the figure.

More particularly, an object of the invention is to provide an artificial eye of the above type which not only appears to exhibit eyeball movement, but which is bright and full of life.

Also an object of this invention is to provide low cost and efficient techniques for making artificial eyes of the above type.

A significant advantage of the invention is that the artificial eyes when applied to a toy figure or character act to impart life thereto, for the figure seems to be reactive to a child playing with the figure. As the child holds the figure and moves it around, its eyes appear to respond to this movement.

Briefly stated, these objects are attained in a toy figure having artificial eyes which when viewed by an observer, create, as a result of an optical illusion, apparent eyeball movement as the observer changes his orientation relative to the figure. Each artificial eye is constituted by a case formed of a transparent sphere or truncated sphere having a ball supported concentrically therein to simulate an eyeball. The artificial eye is mounted on the head of the figure to expose its convex frontal section, this being covered by a mask having a window therein which displays the eyeball and the regions above and below the eyeball and those on either side thereof. As a consequence, an observer looking at the artificial eye in a direction normal thereto in alignment with the eyeball center sees the eyeball in its centered position. But as the observer changes his position relative to the figure and views the eye through the window in a direction at an angle to the alignment direction, then the eyeball appears to be displaced from its normal position upwardly or downwardly or to one side thereof to an extent that depends on the angle of view, whereby the eyeball seems to follow the observer's movement.

BRIEF DESCRIPTION OF DRAWINGS

For a better understanding of the invention as well as other objects and further features thereof, reference is made to the following detailed description to be read in conjunction with the accompanying drawings, wherein:

FIG. 1 shows a toy figure having artificial eyes in accordance with the invention;

FIG. 2 is a front view of one of the eyes;

FIG. 3 is a side view of this eye, showing how the eye is frontally mounted, the rear section of the eye mask being cut away to expose the underlying sphere and a reflective coating thereon;

FIG. 4 is a top view of the eye;

FIG. 5 illustrates, in section, how an eye in accordance with the invention can be assembled from three pieces;

FIG. 6 shows how the eye can be made by an injection molding technique;

FIG. 7 shows an alternative form of case for the eye;

FIG. 8 illustrates still another embodiment of the artificial eye; and

FIGS. 9A to E illustrate how apparent eyeball movement is effected; A showing the eye when viewed first in an alignment direction and then at an angle to one side of this direction; B showing the position of the eyeball when viewed in the alignment direction; C showing the position of the eyeball when viewed in the side direction; D showing the eye when viewed in a direction from a position below the alignment direction; and E showing the resultant eyeball position.

DESCRIPTION OF INVENTION

Structure of Eye

Referring now to FIG. 1, there is shown a toy play FIG. 10 whose head 11 is provided with a pair of artificial eyes 12 in accordance with the invention. In practice, this figure can be a doll molded of rigid or semi-rigid material, or it may be a "soft figure" having a fabric casing stuffed with a compressible material such as flexible, foam plastic pellets or shredded fibrous matting.

The figure may be in any fanciful humanoid or animal like form, or it may be an established character, such as Donald Duck, Mickey Mouse or any of the figures which populate the Sesame Street TV series for children. The fact that this character has eyes in accordance with the invention which react to the child playing with the character significantly enhances the appeal of this character, who then seems to have developed a special relationship with the child.

Each eye 12, as shown in FIGS. 2, 3 and 4, is constituted by a case formed by a transparent plastic sphere 13 having concentrically mounted therein an opaque ball 14 of smaller diameter which simulates an eye ball. Covering the exterior of sphere 13 and conforming thereto is an opaque mask 15 formed, for example, of closely woven fabric material, a thin plastic film, or enamel paint. Defined in the mask in the frontal section of the sphere and conforming to its curvature is an eye-shaped or oval window 16.

The eye is so mounted with respect to casing 17 of the head of the figure that, as shown in FIG. 3, only the frontal convex section of the sphere which includes the oval window 16 in the mask is exposed to an observer. The manner in which this mounting is effected is appropriate to the structure of the figure. Thus, if the head is in a molded plastic form, it may be provided with indented sockets to receive the eyes. And in the case of figures having a head of flexible fabric material, the eye may be held in a pocket which can be attached to an opening in the material. In practice, the artificial eye may be held in the pocket by a lock washer or similar device.

As indicated by the dotted line 16A in FIG. 4, the mask may be brought forward to form a smaller window, depending on the optical effect desired.

The exterior surface of the transparent sphere in the rear section thereof is provided with a reflective layer 18 formed of white paint or any other known reflective coating to create a reflective, concave background. This background acts to collect light incident to the exposed frontal section of the sphere and directs it toward the eyeball. The reflective paint or coating may be colored to provide contrast with the eyeball which may be black, brown or blue, or any other eyeball color. The reflective layer also serves, because of its reflective properties, to internally brighten the eye and avoid the dull look characteristic of the typical artificial eye.

Or the background paint on the sphere may be of phosphorescent material so that the artificial eye will glow in the dark and retain its apparent eyeball movement characteristic.

The artificial eye may be made of three pieces which, as shown in FIG. 5, comprises a small, black plastic ball 14' which is held in the center of a transparent, solid plastic sphere 13' having a cavity 19 therein to admit and accommodate the ball, and a transparent plastic plug 20 of the same material as the sphere, such as polyvinyl chloride, polystyrene or polymethyl mathacrylate, the enlared head 20H of the plug being bonded to the sphere to seal the cavity. Coated on the rear section of the sphere and the head of the plug is the reflective layer 18. The space between plug 20 and cavity 19 is preferably filled with clear glycerine to avoid any optical discontinuity.

Another way of making the artificial eye is by injection molding, as shown in FIG. 6, in which case ball 14'' is supported in the mold by a transparent pin 21 inserted in a hole drilled in the ball while sphere 13'' is injection molded thereabout. Alternatively, as shown in FIG. 7, stem or pin 21 may be molded onto eyeball 14'' and supported while a truncated sphere 22 is molded thereabout, the ball being concentric with convex curvature of the frontal section of sphere 22.

To more closely approximate a human eye, the artificial eye, as shown in FIG. 8, may be formed by a small, black opaque ball 23 concentrically supported within a larger transparent ball 24 having a blue or brown hue which is concentrically supported within a clear plastic spherical case 25.

Operation of the Artificial Eye

Referring now to FIG. 9A, in order to explain the optical behavior of the artificial eye, the eye is shown in the horizontal plane, with eyeball 14 concentrically disposed within transparent spherical case 13. The eyeball is exposed to an observer through window 16 in the frontal section thereof, as previously explained.

When an observer views eyeball 14 through window 16 in a direction $D_1$ normal to horizontal axis X going through the diameter of the eye, direction $D_1$ being aligned with axis Y that goes through the center of the eyeball and is at right angles to axis X, then, as shown in FIG. 9B, eyeball 14 is seen by the observer in its center position within the artificial eye.

But if now the observer moves to a position at which his orientation is such that he sees eyeball 14 in a direction $D_2$ which, as shown in FIG. 9A, is at an angle to alignment direction $D_1$ to one side thereof in the horizontal plane, then direction $D_1$ goes through the center of eyeball 14 along axis Z. The observer now sees the eyeball at a position at which axis Z intercepts window 16. This position, as shown in FIG. 9C is displaced to one side of the centered position of the eyeball. The eyeball has, of course, not changed its actual position, but because of an optical illusion, the observer receives the impression that the eyeball has moved.

And if the observer now moves from a position at which he views the eye in direction $D_2$ to a position on the opposite side of alignment direction $D_1$ at an angle thereto, the eyeball will seem to be moving from its position shown in FIG. 9C toward the opposite side of window 16, whereby the eyeball appears to be following the observer.

FIG. 9D shows in a vertical plane, a direction of observation $D_3$ which is under or below alignment direction $D_1$, and at an angle thereto. Eyeball 14 then, as shown in FIG. 9E, appears to be positioned below its centered position so that one now receives the optical impression of downward eyeball movement. And if the observer then shifts his position so as to view the eye in a direction which is above the alignment direction and at an angle thereto, then the eyeball gives the impression of upward movement, again following the observer.

As a consequence, eyeball 14 appears to follow the observer upwardly or downwardly or to the left or right side as he changes his angular position or orientation relative to the artificial eye. Though the eyeball is actually stationary, because of the optical illusion, simulated animation is imparted thereto which causes the figure to appear to react to the observer.

While there has been shown and described a preferred embodiment of a synthetic eye simulating eyeball movement in accordance with the invention, it will be appreciated that many changes and modifications may be made therein without, however, departing from the essential spirit thereof.

I claim:

1. An artificial eye which when mounted on the head of a toy figure appears to follow an observer as he changes his angular orientation with respect to the eye, said eye comprising:

A. a transparent case having a generally spherical form, so mounted on the head of the figure as to expose its convex frontal section and to conceal its rear section;

B. a spherial ball mounted concentrically at a fixed position within the case and having a distinctive color; and C. an opaque mask covering at least a portion of the case and provided at the convex frontal section of the case with a window that exposes the ball as well as the regions above and below and on either side of the ball, whereby an observer viewing the artificial eye through the window in a direction normal thereto in alignment with the ball center then sees the ball in its centered position; but as the observer moves relative to the figure and changes his orientation to view the eye through the window in a direction at an angle to the alignment direction, then the ball appears to be displaced from its centered position upwardly or downwardly or to one side thereof to an extent that depends on the angle of view, thereby giving the optical impression that the ball is following the observer's movement.

2. An artificial eye as set forth in claim 1, wherein said ball is a solid ball having a distinct color.

3. An artificial eye as set forth in claim 1, wherein said ball is constituted by a small inner black ball that is concentrically disposed within a larger transparent sphere having a distinct hue.

4. An artificial eye as set forth in claim 1, further including a reflective layer on the surface of the case on the rear section thereof to form a concave reflective background directing light incident to the frontal section of the spherical case toward said ball.

5. An artificial eye as set forth in claim 4, wherein said reflective layer is formed by white paint.

6. An artificial eye as set forth in claim 1, wherein said window has an oval geometry that is symmetrical with respect to the ball.

7. An artificial eye as set forth in claim 4, wherein said reflective layer has a color which contrasts with that of the ball.

8. An eye as set forth in claim 1, further including a phosphorescent layer on the surface of the spherical case on its rear section to cause said eye to glow in the dark.

9. An eye as set forth in claim 1, wherein said ball is supported within a cavity formed in said case by a transparent plug having an enlarged head sealed to the case.

10. An eye as set forth in claim 1, wherein said ball is supported by a transparent pin, and said case is injection molded about said supported ball.

* * * * *